United States Patent [19]

Kårdén

[11] 3,964,212

[45] June 22, 1976

[54] PNEUMATIC GRINDING MACHINE PROVIDED WITH DUST REMOVING MEANS

[75] Inventor: Karl Gösta Kårdén, Nacka, Sweden

[73] Assignee: Atlas Copco Aktiebolag, Nacka, Sweden

[22] Filed: Mar. 10, 1975

[21] Appl. No.: 557,116

[30] Foreign Application Priority Data

Mar. 22, 1974 Sweden ..... 74038837

[52] U.S. Cl. ..... 51/170 PT; 51/170 T

[51] Int. Cl.² ..... B24B 23/00

[58] Field of Search ..... 51/170 PT, 170 T, 170 R, 51/273; 285/134

[56] References Cited

UNITED STATES PATENTS

| | | | |
|---|---|---|---|
| 2,717,166 | 9/1955 | Hedden | 285/134 |
| 2,805,087 | 9/1957 | Shaw et al. | 285/134 |

FOREIGN PATENTS OR APPLICATIONS

| | | | |
|---|---|---|---|
| 246,520 | 10/1947 | Switzerland | 285/134 |
| 59,181 | 11/1941 | Denmark | 285/134 |
| 976,304 | 10/1950 | France | 51/170 PT |

*Primary Examiner*—James L. Jones, Jr.
*Attorney, Agent, or Firm*—Flynn & Frishauf

[57] ABSTRACT

A pneumatic grinding machine provided with a dust collector which partly surrounds the grinding tool and which is connected to a suction source through a dust conveying conduit. The maneuverability of the machine is improved by utilizing rotatable connections for the dust conveying conduit as well as for the pressure air supply conduit and by arranging said connections rotatable relative to the machine for rotation about a common axis. The rotatability of these conduits is accomplished by swivel means disposed as the outer end of a machine handle. Alternatively, the connections are associated with the dust collector.

13 Claims, 5 Drawing Figures

PNEUMATIC GRINDING MACHINE PROVIDED WITH DUST REMOVING MEANS

This invention relates to a pneumatic grinding machine fitted with dust removing means. The dust removing means comprises a dust collector attached to the machine housing so as to partly surround the grinding tool, and a connection for a dust conveying conduit communicating with the dust collector.

A problem arising in machines of this type relates to the maneuverability of the machine which is seriously affected by the rather stiff and heavy dust conveying conduit connected thereto. Since such a machine is connected to a pressure air supply conduit as well, the handling of the machine is rather difficult to handle and heavy, especially when working surfaces of different location and orientation.

The above problem is intended to be solved by this invention as defined by the claims.

Preferred embodiments of the invention are hereinafter described in detail with reference to the accompanying drawings.

DETAILED DESCRIPTION

Figure 1:
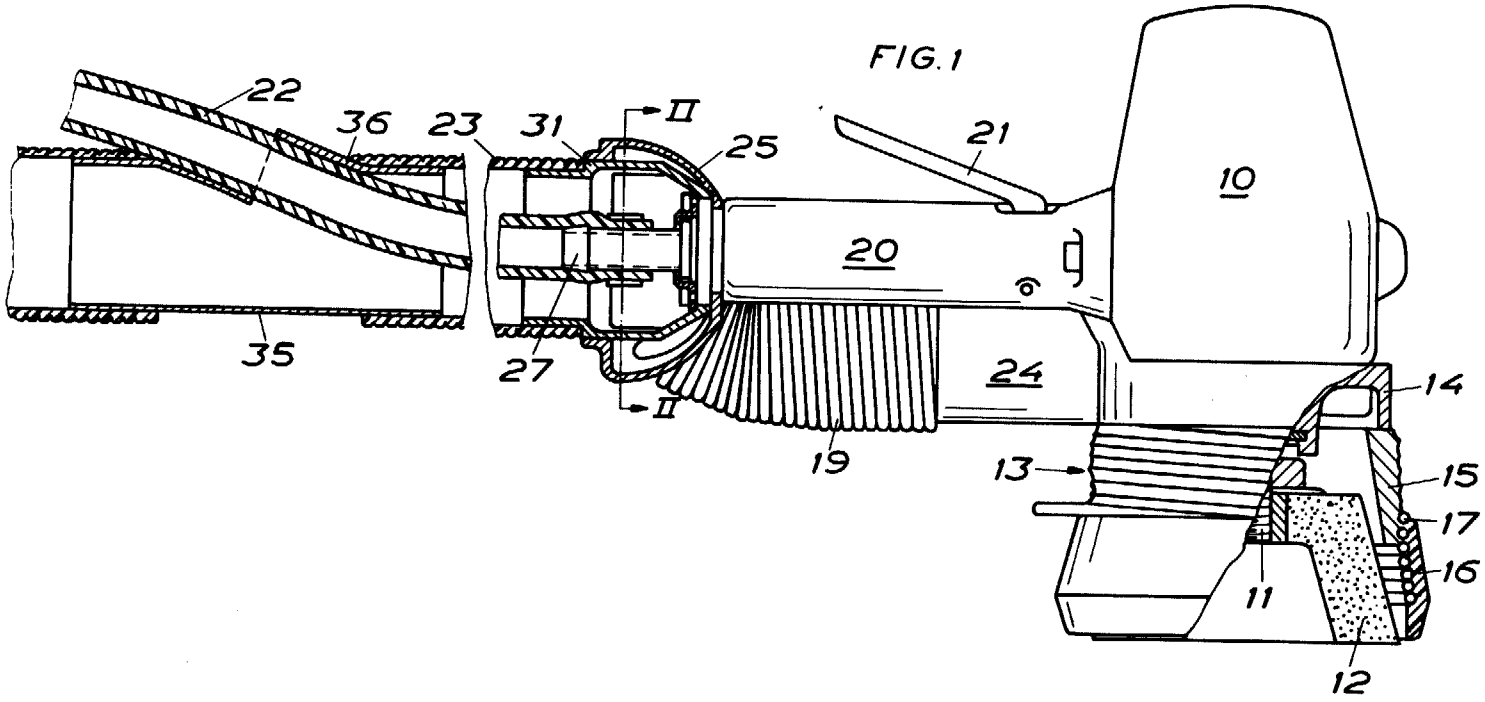
FIG. 1 shows, partly in section, a side elevation of a grinding machine according to the invention.
Figure 2:
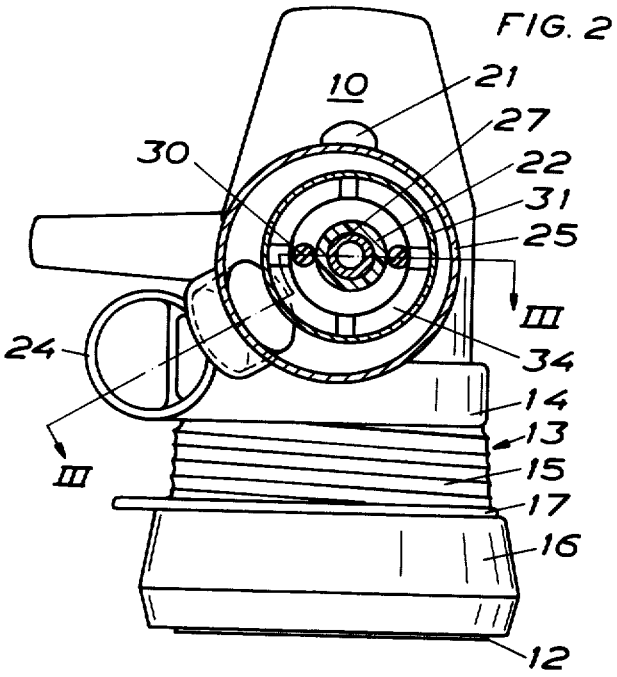
FIG. 2 is an end view of the grinding machine which is shown in FIG. 1, wherein the conduit connections are shown in a section taken along line 11—11 in FIG. 1.
Figure 3:
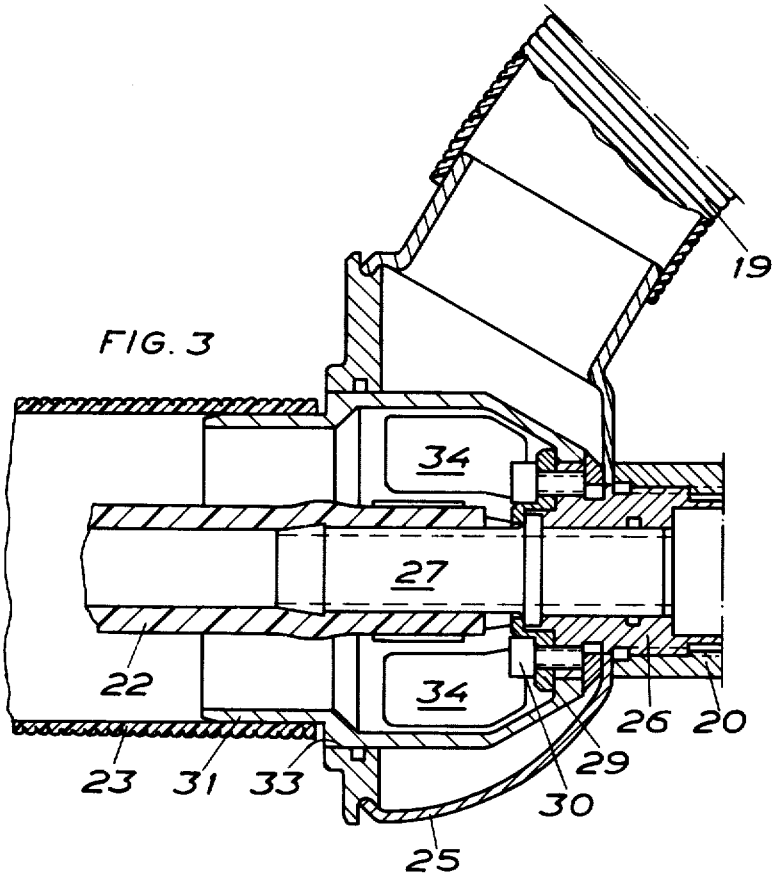
FIG. 3 shows, in larger scale, a longitudinal section through the conduit connections according to line III—III in FIG. 2.

The grinding machine illustrated in FIGS. 1, 2 and 3 comprises a housing 10 in which a pneumatic vane motor is lodged. The motor rotates an output shaft 11 to which is attached a cup-shaped grinding tool 12. The housing 10 is provided with a dust collector or suction hood 13, which extends coaxially with and partly surrounds the grinding tool 12.

The dust collector 13 comprises the front end wall 14 of the machine housing 10, a tubular socket 15, a forward, flexible sleeve 16 and an outlet duct 24 extending laterally from the end wall 14. The front end wall 14 and the socket 15 are rigidly secured to the machine housing 10. The socket 15 is provided with external threads by means of which the sleeve 16 is adjustable axially relative to the housing 10 and the grinding tool 12. The flexible sleeve 16 is provided with a coil spring 17, which is intended to cooperate with the threads on the socket 15. The diameter of the spring 17 is slightly less than that of the socket threads in order to obtain a frictional lock therebetween.

Further, the grinding machine is provided with a handle 20 which is hollow and constitutes a supply passage for motive pressure air to the motor. This passage includes a control valve which is operated by a trigger 21.

At its outer end, the handle 20 carries a connection means for a motive air supply conduit 22 and a dust conveying conduit 23. The connection means comprises a suction shell 25 which is rigidly attached to the handle 20 and which communicates with the outlet duct 24 of the dust collector 13 via a hose 19. As shown in FIG. 3, the shell 25 is affixed relative to the handle 20 by means of a bushing 26 which is threaded into the outer end thereof.

A connection pipe 27 for the pressure air hose 22 is received in the bushing 26 and locked axially thereto by means of a retainer ring 29 and screws 30. Yet, the connecting pipe 27 is rotatable relative to the bushing 26 and the handle 20.

A connection sleeve 31 for receiving the dust conveying conduit 23 is rotatably supported by the bushing 26 and the shell 25 for rotation about an axis which is common to that of the connection pipe 27. Thereby, the connection sleeve 31 is supported by the external surface of the bushing 26 and by an opening 33 in the suction shell 25. The sleeve 31 is axially locked by the retainer ring 29 and the screws 30, similarly to the axial locking of the connection pipe 27. The part of the sleeve 31 which is located inside the shell 25 is provided with large openings 34 through which communication is established between the sleeve 31 and the dust collector 13 via the shell 25, the hose 19 and the outlet duct 24.

According to the embodiment shown in FIG. 1, the pressure air conduit 22 runs inside the dust conveying conduit 23 over a distance of 1 – 1.5 meters from the machine. This arrangement is advantageous in that there is only one conduit for the operator to handle, which makes the work easier.

If the coaxial position of the conduits would be maintained for a longer distance, the suction power within the dust conveying conduit would be seriously impaired.

For leading the pressure air conduit 22 out of the conveying conduit 23 there is inserted in the latter a tube element 35 which has a lateral, sealed-off opening 36. The opening 36 forms an acute angle with the longitudinal axis of the tube element 35.

Figure 4:
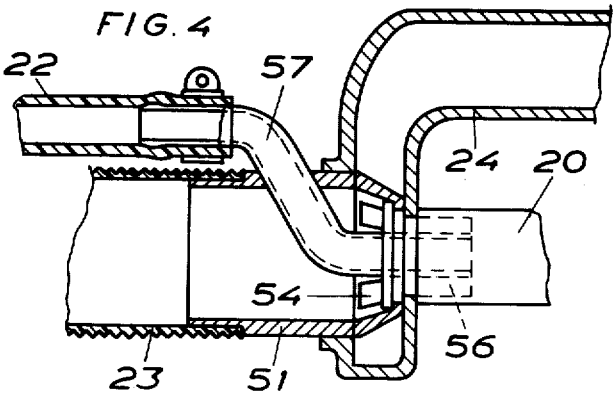
FIG. 4 shows a longitudinal section through an alternative design of the conduit connections.

In FIG. 4 there is shown an alternative design of the conduit connections. Similarly to the above described embodiment, the machine according to this embodiment comprises an inner connection pipe 57 for the motive air conduit 22 and an outer connection sleeve 51 for the dust conveying conduit 23. The connection pipe 57 is Z-shaped and extends out through a lateral opening in the sleeve 51 for receiving the motive air hose 22. So, in this case, the motive air conduit 22 does not run inside the dust conveying conduit 23. Yet, the conduits are rotatable about a common axis which is defined by a bushing 56 in the handle 20. As in the preceding embodiment, the bushing 56 rotatably receives the connection pipe 57 for the pressure air hose 22, and constitutes a fastening element for a suction shell which, in this embodiment of the invention, is formed in one piece with the outlet duct 24 of the dust collector 13. The bushing 56 also supports the forward end of the connection sleeve 51. The sleeve 51 is rotatably supported by the bushing 56 and by an opening in the shell or outlet duct 24, and communicates with the latter through openings 54.

Figure 5:
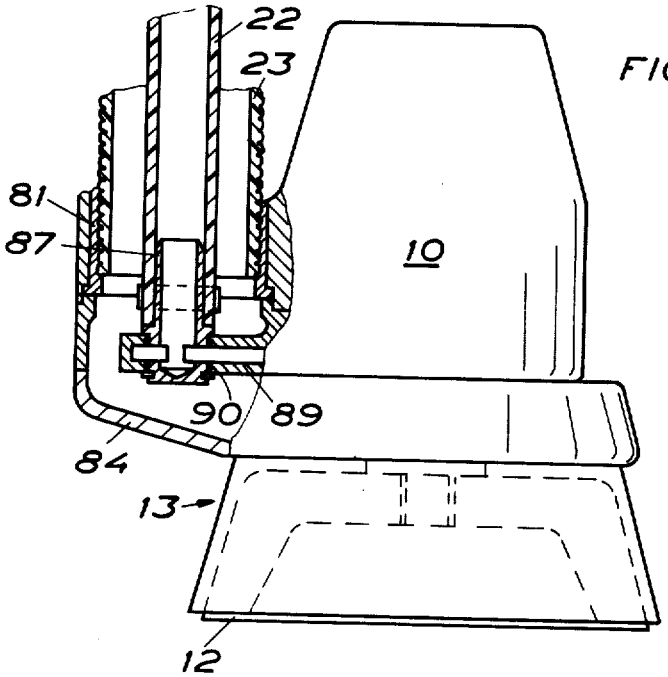
FIG. 5 shows, partly in section, a grinding machine provided with conduit connections according to the invention.

In FIG. 5 there is shown still another arrangement of the hose connections of the machine. According to this embodiment the hoses are connected directly to the outlet duct 84 of the dust collector 13 for rotation about an axis which is parallel to the rotation axis of the grinding tool 12.

The dust conveying hose 23 is fixedly received in a sleeve 81 which is rotatably journalled relative to the outlet duct 84. A projection 89 of the housing 10 extends transversely into the duct 84 in order to form a swivel joint for the pressure air hose 22. The swivel joint comprises a cylindrical opening 90 extending through the projection 89 and a connection pipe 87 rotatably journalled therein. The sleeve 81 and the connection pipe 87 are arranged coaxially relative to each other.

The machine shown in FIG. 5 is adapted for working horizontal surfaces. The vertically directed hose connections are advantageous in that the hoses may be suspended at a point located above the machine and thereby be prevented from interfering with the maneuvering of the machine.

The invention is not limited to the shown and described embodiments but may be freely varied within the scope of the claims.

What I claim is:

1. Dust removing device for a hand held pneumatic grinding machine, comprising:

a machine housing carrying a rotatable grinding tool, a dust collector which is attached to the machine housing and arranged to at least partly surround the grinding tool, and means for coupling a pressure air supply conduit to the machine and a dust conveying conduit in communication with said dust collector, the improvement wherein said coupling means comprises swivel means for rotatably coupling the dust conveying conduit and the pressure air supply conduit to the machine with the dust conveying conduit and the pressure air supply conduit substantially coaxial with each other and rotatable about a common axis relative to the machine.

2. Device according to claim 1, wherein said swivel coupling means includes swivel connections for the air supply conduit and for the dust conveying conduit, the connection for the air supply conduit being located inside and coaxially directed relative to the connection for the dust conveying conduit.

3. Device according to claim 1, wherein the common rotation axis of the swivel conduit couplings is substantially perpendicular to the rotation axis of the grinding tool.

4. Device according to claim 2, wherein the grinding machine includes a handle carrying a control valve for operating the machine, and wherein the conduit connections are located at the outer end of the handle of the machine.

5. Device according to claim 1, wherein the common rotation axis of the swivel conduit couplings is substantially parallel to the rotation axis of the grinding tool.

6. Device according to claim 4, wherein the swivel means for coupling the dust conveying conduit to the machine comprises a shell which is firmly secured to the machine handle and which communicates with the dust collector, and a sleeve rotatably journalled relative to said shell, said sleeve extending out of said shell for receiving the dust conveying conduit.

7. Pneumatic grinding machine comprising:

a housing, an output shaft journalled in said housing, said output shaft carrying a grinding tool at its forward end, a dust collector attached to said housing and arranged so as to at least partly surround the grinding tool, and a connection for a pressure air supply conduit and a connection for a dust conveying conduit communicating with said dust collector, said connections including swivel means for substantially coaxially and rotatably coupling said conduits relative to said housing for rotation about a common axis.

8. Device according to claim 2, wherein the common rotation axis of the swivel conduit connections is substantially perpendicular to the rotation axis of the grinding tool.

9. Device according to claim 2, wherein the common rotation axis of the swivel conduit connections is substantially parallel to the rotation axis of the grinding tool.

10. Device according to claim 1, wherein said coupling means for the pressure air supply conduit and for the dust conveying conduit further comprises a connection tube which is connectable to the dust conveying conduit, and a lateral opening in a wall of said tube for receiving a pressure air conduit from outside said tube in an air-tight manner.

11. Device according to claim 10, wherein said lateral opening is a sealed-off opening forming an acute angle with the longitudinal axis of the conveying tube for passing the pressure air supply conduit from outside the tube to a substantially coaxial relationship inside said tube.

12. Device according to claim 10, wherein said connection tube is no more than 1.5 meters from the machine housing.

13. Pneumatic grinding machine comprising:

a housing, an output shaft journalled in the housing, said output shaft carrying a grinding tool, a dust collector attached to the housing and arranged so as to at least partly surround the grinding tool, a connection device attached to the housing for receiving in substantially coaxial relationship a motive air supply conduit and a dust conveying conduit, said dust conveying conduit communicating through said connection device with said dust collector, and being connected to a suction source at its downstream end, and said connection device including swivel means for substantially coaxially and rotatably coupling said conduits to the housing for rotation relative to the housing about a common axis.

* * * * *